US007390251B2

(12) United States Patent
Hadlock, Jr.

(10) Patent No.: US 7,390,251 B2
(45) Date of Patent: Jun. 24, 2008

(54) AIR DUCT COVER AND BOOT

(75) Inventor: Leonard R. Hadlock, Jr., 860 Violetta Cir., Gardnerville, NV (US) 89460

(73) Assignee: Leonard R. Hadlock, Jr., Minden, NV (US)

( * ) Notice: Subject to any disclaimer, the term of this patent is extended or adjusted under 35 U.S.C. 154(b) by 54 days.

(21) Appl. No.: 11/282,580

(22) Filed: Nov. 18, 2005

(65) Prior Publication Data

US 2006/0105700 A1 May 18, 2006

Related U.S. Application Data

(60) Provisional application No. 60/629,853, filed on Nov. 18, 2004.

(51) Int. Cl.
*F24F 13/02* (2006.01)
*F24F 13/06* (2006.01)
*F24F 7/00* (2006.01)

(52) U.S. Cl. ..... 454/330; 454/289; 454/370

(58) Field of Classification Search ..... 454/270, 454/289, 370, 330; 138/89.4, 96 R
See application file for complete search history.

(56) References Cited

U.S. PATENT DOCUMENTS 2,102,681 A * 12/1937 Curtis ..... 454/331
2,348,163 A * 5/1944 Zimmerman ..... 55/440
2,596,182 A * 5/1952 Sosaya ..... 285/3
3,548,735 A * 12/1970 Bankowski et al. ..... 454/297
3,811,633 A 5/1974 Cummings et al.
3,871,145 A 3/1975 Hatmaker
4,046,409 A 9/1977 Virgin
4,249,758 A 2/1981 Harris
4,480,859 A 11/1984 Rueckl et al.
4,625,632 A * 12/1986 Markman et al. ..... 454/290
4,727,908 A 3/1988 Forster
4,773,197 A * 9/1988 Sullivan ..... 52/220.1
4,819,972 A 4/1989 Champa
4,829,886 A * 5/1989 Battaglin ..... 454/289
4,942,271 A 7/1990 Corsi
5,085,251 A 2/1992 Popelka et al.
5,095,942 A 3/1992 Murphy
5,100,445 A * 3/1992 Johnson et al. ..... 55/413
5,129,690 A 7/1992 Meinig et al.
5,135,270 A 8/1992 Arnoldt et al.
5,158,328 A 10/1992 Anderson et al.
D342,130 S 12/1993 Anderson et al.
5,377,361 A * 1/1995 Piskula ..... 4/252.4

(Continued)

*Primary Examiner*—Steven B. McAllister
*Assistant Examiner*—Patrick F. O'Reilly, III
(74) *Attorney, Agent, or Firm*—Workman Nydegger

(57) ABSTRACT

A heating, ventilation and air conditioning (HVAC) system may include one or more ducts and each duct may include one or more sections. A duct section, for example, may include a flange, which may help increase the ease and efficiency of installing the duct section. The flange may also help provide a seal between portions of the duct section and other structures. A duct section may include a cover, which may advantageously help prevent animals, debris and the like from entering and/or passing through the duct section. A duct section may also include a barrier, which may also help prevent animals, debris and the like from entering and/or passing through the duct section. The barrier may also include one or more air-permeable portions through which at least some air may advantageously pass.

35 Claims, 15 Drawing Sheets

U.S. PATENT DOCUMENTS 5,472,380 A * 12/1995 Sarazen et al. ..... 454/290
5,919,278 A * 7/1999 Walker ..... 55/385.1
6,170,529 B1 * 1/2001 Howe ..... 138/89
RE37,086 E * 3/2001 Moore et al. ..... 454/330
6,196,597 B1 3/2001 Karnes
6,203,074 B1 3/2001 Daniel
6,230,418 B1 5/2001 Gomulinski
6,273,145 B1 8/2001 Botting
6,544,115 B1 4/2003 Graf
6,575,827 B1 * 6/2003 Rutler et al. ..... 454/289
6,769,291 B1 * 8/2004 Julian et al. ..... 73/49.8
6,776,709 B1 8/2004 Moore, Jr. et al.
6,780,097 B2 8/2004 Shuttleworth et al.
6,800,024 B1 * 10/2004 Prevost ..... 454/290
6,835,129 B1 * 12/2004 Harris ..... 454/370
2003/0068972 A1 * 4/2003 Snyder ..... 454/330
2003/0098081 A1 * 5/2003 Tarr ..... 138/96 R
2003/0134587 A1 * 7/2003 Hunter ..... 454/289
2003/0177724 A1 * 9/2003 Botting ..... 52/302.1

* cited by examiner

AIR DUCT COVER AND BOOT

CROSS-REFERENCE TO RELATED APPLICATIONS

This application claims priority to and the benefit of United States provisional patent application Ser. No. 60/629,853, filed Nov. 18, 2004 and entitled HEATING VENT WITH DISCHARGE COVER, which is incorporated by reference herein in its entirety.

BACKGROUND OF THE INVENTION

1. Field of the Invention

The present invention generally relates to ducts and, in particular, to ducts that can be used in connection with heating, ventilation and air conditioning (HVAC) systems.

2. Description of Related Art

During construction of an office building, a home or other structures, ducts may be installed for various purposes. For example, one or more ducts may be installed as part of an HVAC system. That is, ducts may form part of a system or network that provides heating, ventilation and/or air conditioning to a structure.

Unfortunately, when a duct is attached to an opening in a wall, a floor or a ceiling, it can be time consuming to properly size the opening to accommodate the duct. Further, when attaching a duct to the opening, it can be difficult to properly align the duct and the opening.

After a duct is installed, other problems may occur. For example, ducts are typically installed before construction is completed. Accordingly, water, dust, dirt, building materials and/or other debris may enter the ducts during the construction process. Consequently, when activated, the HVAC systems may blow this debris throughout the office building or home, creating a mess and a potential health risk. Further, the water and/or debris may promote the growth of mold, bacteria or other pathogens, which the HVAC systems may blow throughout the office building or home.

In addition, birds or other animals may enter and become trapped in the ducts. For example, these animals may get stuck or lost within the ducts and may eventually die within the ducts. Consequently, when activated, the HVAC systems may blow the smell of decaying animals throughout the office building or home. In addition, the decaying animals may create a health risk in the building or home.

BRIEF SUMMARY OF EMBODIMENTS OF THE INVENTION

A need therefore exists for a duct that eliminates or diminishes the disadvantages and problems described above.

One aspect of the invention is a duct that may form part of a ventilation system. For example, the duct may be part of an HVAC or other suitable system. The duct preferably includes a hollow interior portion that allows air to be conveyed or transported through the duct. This allows the duct, for example, to be part of a ventilation system for a home, office and other suitable types of buildings and structures. The duct may also be used with other systems for conveying gases, liquids and/or other materials. In addition, the duct may form part of a housing and/or enclosure such as for wiring, cables and the like.

Another aspect is a duct that may include one or more sections. For example, the duct may be part of a network or system that provides ventilation to a building. The duct may include a boot that is sized and configured to direct ventilation into a room or other enclosure. The duct may also include a pipe, channel and/or conduit that controls or directs the flow of air or ventilation. In particular, the duct may include a conduit that allows air to flow through the duct system and into a boot. The air can then flow out of the boot and into the room. Advantageously, a plurality of sections may be interconnected to form the duct. For example, the duct may include a first section that provides an inlet, a second elongated or connecting section, and a third section that provides an outlet. This third section may be connected to or include a boot, if desired. Significantly, any desired number of sections may be used to form the duct. In addition, the duct may include any desired number and configuration of sections depending, for example, upon the intended type of system. Thus, while a large office building can include numerous inlets, outlets, and the like, other structures may include only a single duct.

Still another aspect is a section of a duct that may include a boot. The boot may include an inlet that allows air to flow into the boot. The boot may also include an outlet that allows air to flow out of the boot. The inlet, for example, may be sized and configured to be connected to another section of the duct such as a conduit. The boot may, for example, comprise a "straight boot," a "side boot," an "end boot" or other suitable configurations of boots.

Yet another aspect is a section of a duct that may include one or more attachment portions, which may be sized and configured to connect the duct to a structure. For example, the duct may include one or more attachment portions that are sized and configured to attach the duct to a structure such a floor, a wall, a ceiling, a truss, a joist, a support and the like.

Still yet another aspect is a section of a duct that may include a body with one or more flanges or projections. The flanges may extend outwardly from the body and the flanges may be disposed along all or a portion of an outer perimeter of the body. The flange is preferably sized and configured to be attached to a structure such as a floor, a wall, a ceiling, a truss, a joist, a support and the like.

Advantageously, the flange may increase the ease and efficiency of installing the duct by acting as a guide to quickly and easily position the duct in the correct location. The flange may also allow the duct to be used in connection with openings and structures of various sizes and configurations. For example, if a section of the duct is intended to be disposed within an opening, then the flange may allow the duct to be positioned within openings of various sizes. That is, an opening need not be slowly and painstakingly sized to accommodate the duct because the flange may extend outwardly to span any gap between the body and the opening. Further, the flange may rest upon a portion of the floor, ceiling or other structure when the duct is being installed. This may facilitate installation of the duct because it may allow, for example, a person to leave that portion of the duct hanging from the supports to retrieve fasteners, adhesives and/or other suitable means used to attach the duct into the desired position. Further, with the flange resting upon the floor and/or the supports, a person may more easily operate a device (such as a nail gun, a staple gun, a hammer or other tool) used to attach the duct to the desired structure.

A further aspect is a duct section that may include a body and a flange that is sized and configured to help provide a seal. For example, the flange and the body may be constructed from plastic and these components may be integrally formed as part of a unitary, one-piece structure. The unitary, one-piece structure may advantageously provide a air-tight and/or water-tight connection between the integrally formed portions of the flange and the body.

Another aspect is a duct section that may include a cover to an opening. The cover is preferably removable to allow access to an inlet or outlet to the duct section. The cover may be used to protect the opening and/or prevent items from entering the opening. For example, the cover may advantageously help prevent animals, water, dust, dirt, building materials and/or other debris from entering the duct section via the inlet-outlet opening.

A further aspect is a duct section that may include a cover with a surface that is sized and configured to be generally aligned with another surface. For example, the outer surface of the cover may be generally aligned with the floor, wall, ceiling and the like. The other surface of the cover may also be spaced apart from and/or generally parallel to the floor, wall, ceiling and the like, if desired. In addition, the outer surface of the cover may be disposed generally flush with the floor, wall, ceiling and the like, if desired. Advantageously, because the outer surface of the cover may be generally aligned with another surface, the cover may be less likely to be inadvertently struck or displaced. Additionally, this may facilitate construction and/or use of the duct because the cover may not protrude outwardly or be recessed from surfaces such as the floor, wall, ceiling or the like.

Yet another aspect is a duct section that may include a body, a cover and a narrowed portion. The narrowed portion may be disposed along all or just a section of an outer perimeter of the cover, and the narrowed portion may be used to connect the cover to the body. The duct section may also include a flange, and the narrowed portion may be used to connect the cover to the flange and/or the body.

Still another aspect is a duct section that may include a body, a cover, a flange and a connecting or narrowed portion. All or a portion of the body, cover, flange and narrowed portion may be integrally formed as part of a unitary, one-piece structure. Advantageously, the unitary, one-piece structure may provide a generally air-tight and/or water-tight connection between the integrally formed portions, which may advantageously help prevent water, dust, dirt, and/or other debris from entering the duct section.

Still yet another aspect is a duct section that may include a connecting or narrowed portion that is sized and configured to facilitate removal of a cover. For example, the narrowed portion may include scoring, grooves, channels and the like that are sized and configured to facilitate removal of the cover. In particular, the narrowed portion may be more easily folded, cut and/or torn. The narrowed portion may include perforations to facilitate removal of the cover. The narrowed portion may be sized and configured to facilitate removal of the cover without tools; however, the narrowed portion may facilitate removal of the cover using a knife, scissors, a saw, and/or other tools.

Another aspect is a duct section that may include a barrier. The barrier may advantageously help prevent animals, water, dust, dirt, building materials and/or other debris from passing through the duct section. The barrier may be sized and configured to be selectively removed from and returned to the duct section. The barrier may also be sized and configured to be selectively removed and replaced with another barrier, if desired. In addition, the barrier may include one or more air-permeable portions such as an air filter, a porous structure, a perforated structure, a net, a grate or other structure through which at least some air may pass. The air-permeable portions of the barrier may advantageously permit an HVAC system to transmit at least some air through the duct section. For example, during construction, it may be desirable to operate the HVAC system to transmit heated or cooled air to various portions of the home, building or structure, which may provide construction workers with a more comfortable working environment. Thus, the barrier may advantageously be sized and configured to permit transmission of at least some air through the duct section, but still may prevent at least some debris from passing through the duct section. Further, the barrier may advantageously help extract impurities from air passing through the duct section depending, for example, upon the particular configuration of the air-permeable portions.

Advantageously, the barrier may be disposed in any suitable portions of the duct. For example, the barrier may be disposed within the hollow interior portion of the body of a section of the duct. The barrier may also abut, contact, engage and/or be attached to an interior surface of the body. In addition, the barrier may have one or more dimensions larger than the dimensions of one or more portions of the body of the duct section, which may permit the barrier to rest within the body of the duct section.

A further aspect is a duct that may include one or more components constructed from plastic. Advantageously, the plastic components may be relatively lightweight, which may reduce shipping costs and make the duct easier to install. Also, the plastic components may be relatively strong and/or durable. Additionally, the plastic components may be relatively weather and moisture resistant. Further, the plastic components may be quickly and easily manufactured via a molding process, such as injection molding, compression molding, rotary molding or other suitable molding process. Advantageously, any combination of the plastic components of the duct section may be integrally formed during a molding process as part of a unitary, one-piece structure. It will be understood that the components of a duct section need not be constructed using a molding process and that other manufacturing processes may be used to construct the duct section. It will be also understood that some or all of the components of a duct section may be constructed using metal, plastic, synthetics, polymers, and/or other materials having other characteristics.

These and other aspects, features and advantages of the present invention will become more fully apparent from the following detailed description of preferred embodiments and appended claims.

BRIEF DESCRIPTION OF THE DRAWINGS

The appended drawings contain figures of preferred embodiments to further illustrate and clarify the above and other aspects, advantages and features of the present invention. It will be appreciated that these drawings depict only preferred embodiments of the invention and are not intended to limit its scope. The invention will be described and explained with additional specificity and detail through the use of the accompanying drawings in which.

DETAILED DESCRIPTION OF THE PREFERRED EMBODIMENTS

The present invention is generally directed towards a duct that may be used in connection with a heating, ventilation and air conditioning (HVAC) system. As used herein, a "HVAC system" is a system that may provide heating, ventilation and/or air conditioning. Thus, the HVAC system may provide only heating, only ventilation and/or only air conditioning, and the HVAC system may provide any combination of heating, ventilation and air conditioning. The principles of the present invention, however, are not limited to a duct for an HVAC system. It will be understood that, in light of the present disclosure, the duct disclosed herein can be successfully used in connection with other types of systems.

Additionally, to assist in the description of the duct, words such as top, bottom, front, rear, right and left may be used to describe the accompanying figures, which are not necessarily drawn to scale. It will be appreciated, however, that the present invention can be located in a variety of desired positions, including various angles, sideways and even upside down. A detailed description of the duct now follows.

As discussed above, a duct may be part of an HVAC or other suitable system. The duct preferably includes a hollow interior portion. Advantageously, an HVAC system may use the hollow interior portion of the duct as part of a conduit through which the HVAC system may convey air. However, the hollow interior portion of the duct may be used with a variety of other systems for conveying gases, liquids and/or other materials. In addition, the duct may form part of a housing and/or enclosure. For example, the duct may be used to house and/or enclose electrical wiring, network cables or other communications mediums, and/or other structures.

Figure 1:
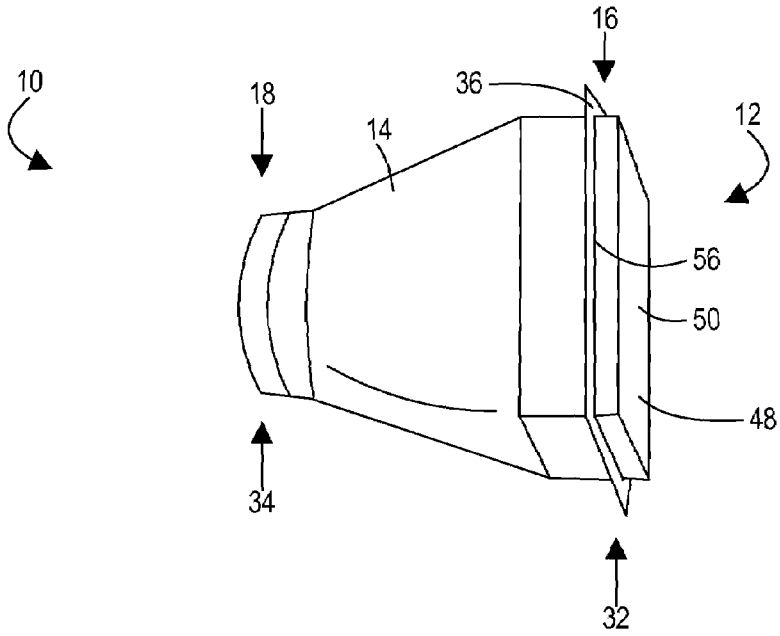
FIG. 1 is a perspective view of an exemplary embodiment of a duct section, the duct section including a body, a flange and a cover.

The duct may be part of a network and it may include one or more sections. For example, as shown in FIG. 1, the duct 10 may also include a hollow interior portion and the duct may include an inlet and an outlet. One of ordinary skill in the art will appreciate that the duct 10 may be arranged in a wide variety of suitable arrangements and configurations. One of ordinary skill in the art will also appreciate that the duct 10 may include any suitable number of sections, inlets, outlets and the like. It will also be appreciated that the duct 10 may include only a single duct section, if desired.

Figure 2:
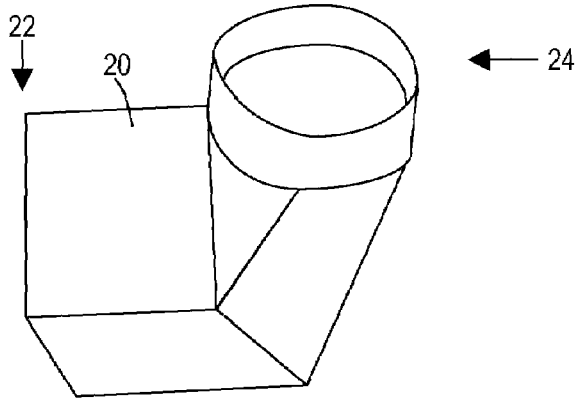
FIG. 2 is a perspective view of another exemplary embodiment of a body of a duct section.
Figure 3:
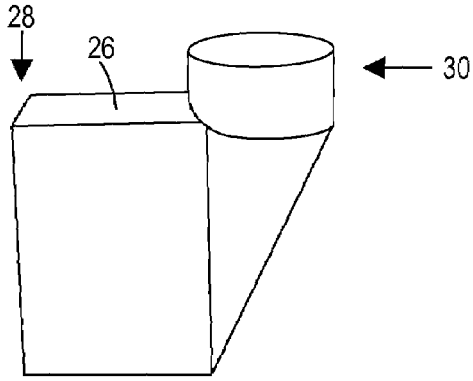
FIG. 3 is a perspective view of yet another exemplary embodiment of a body of a duct section.
Figure 4:
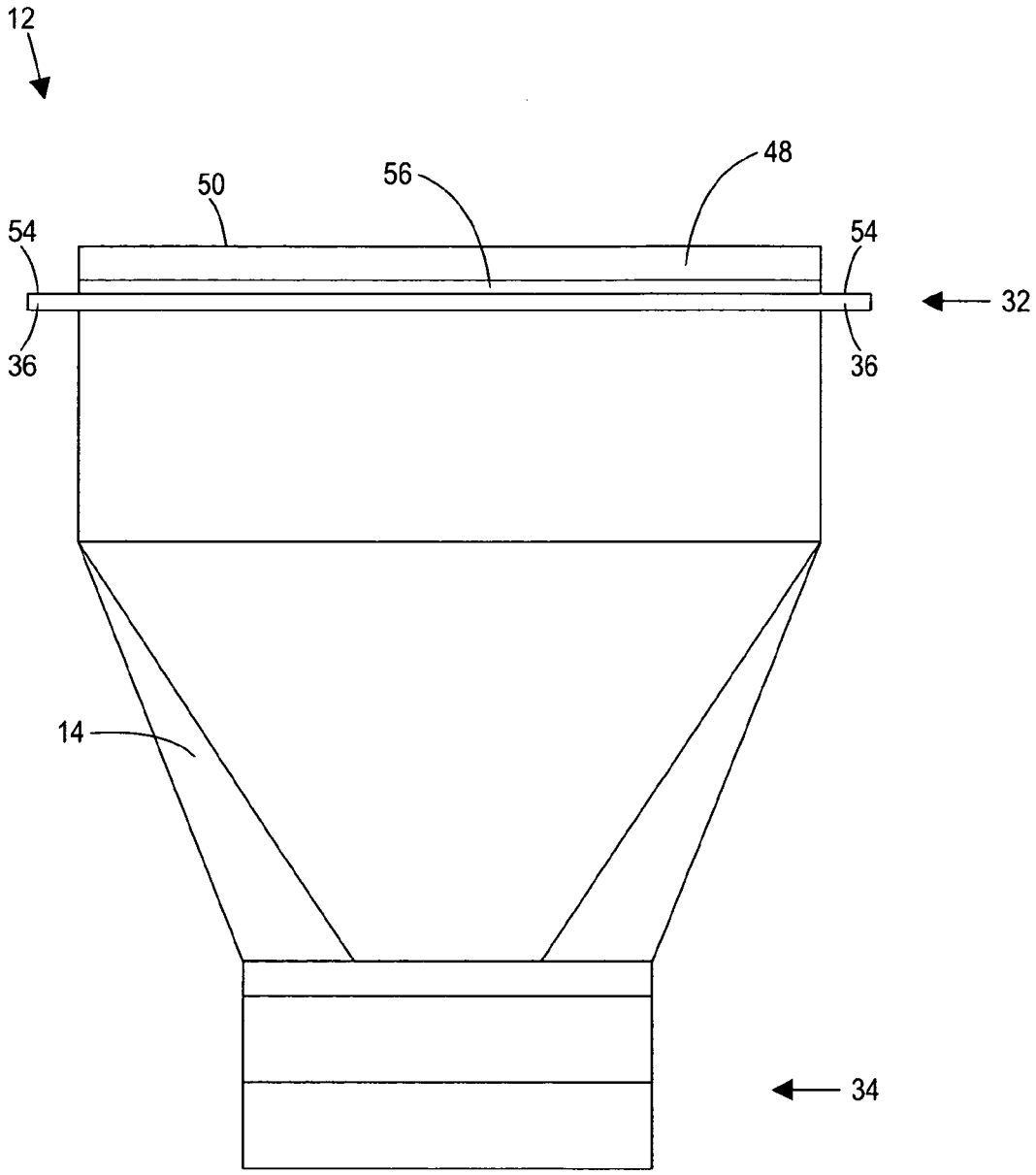
FIG. 4 is a front elevation view of the duct section shown in FIG. 1.
Figure 5:
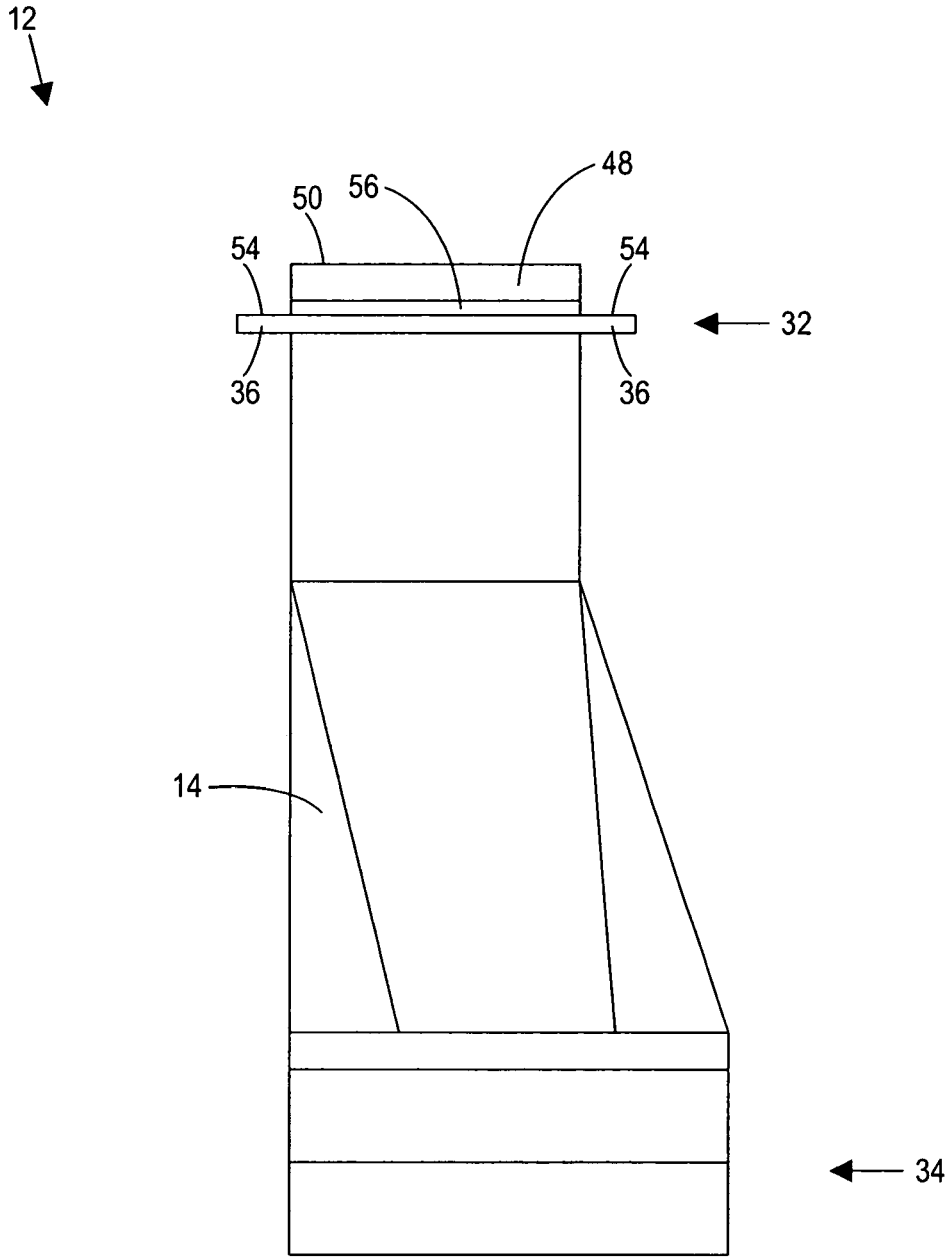
FIG. 5 is left side elevation view of the duct section shown in FIG. 1.
Figure 6:
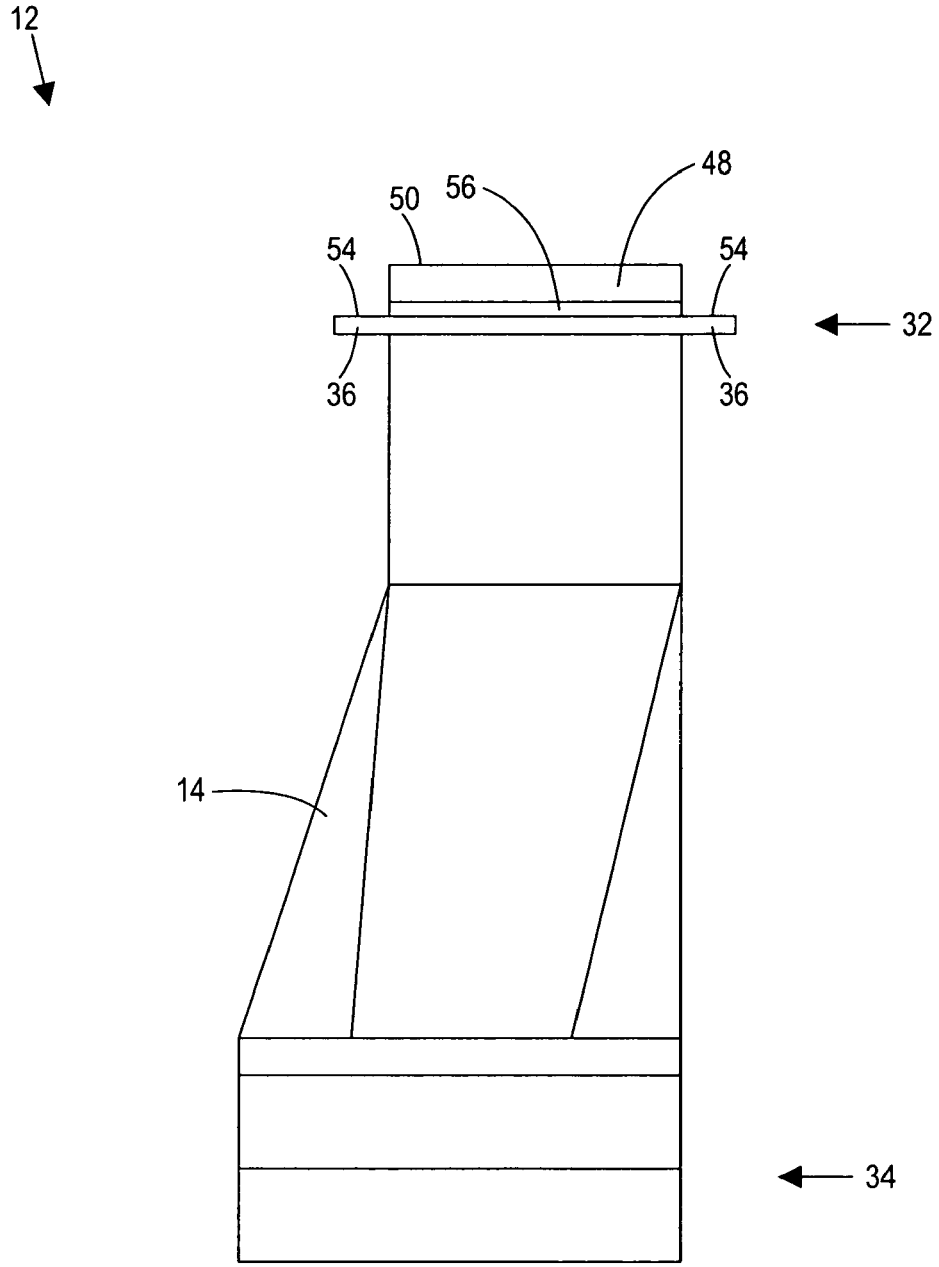
FIG. 6 is a right side elevation view of the duct section shown in FIG. 1.
Figure 7:
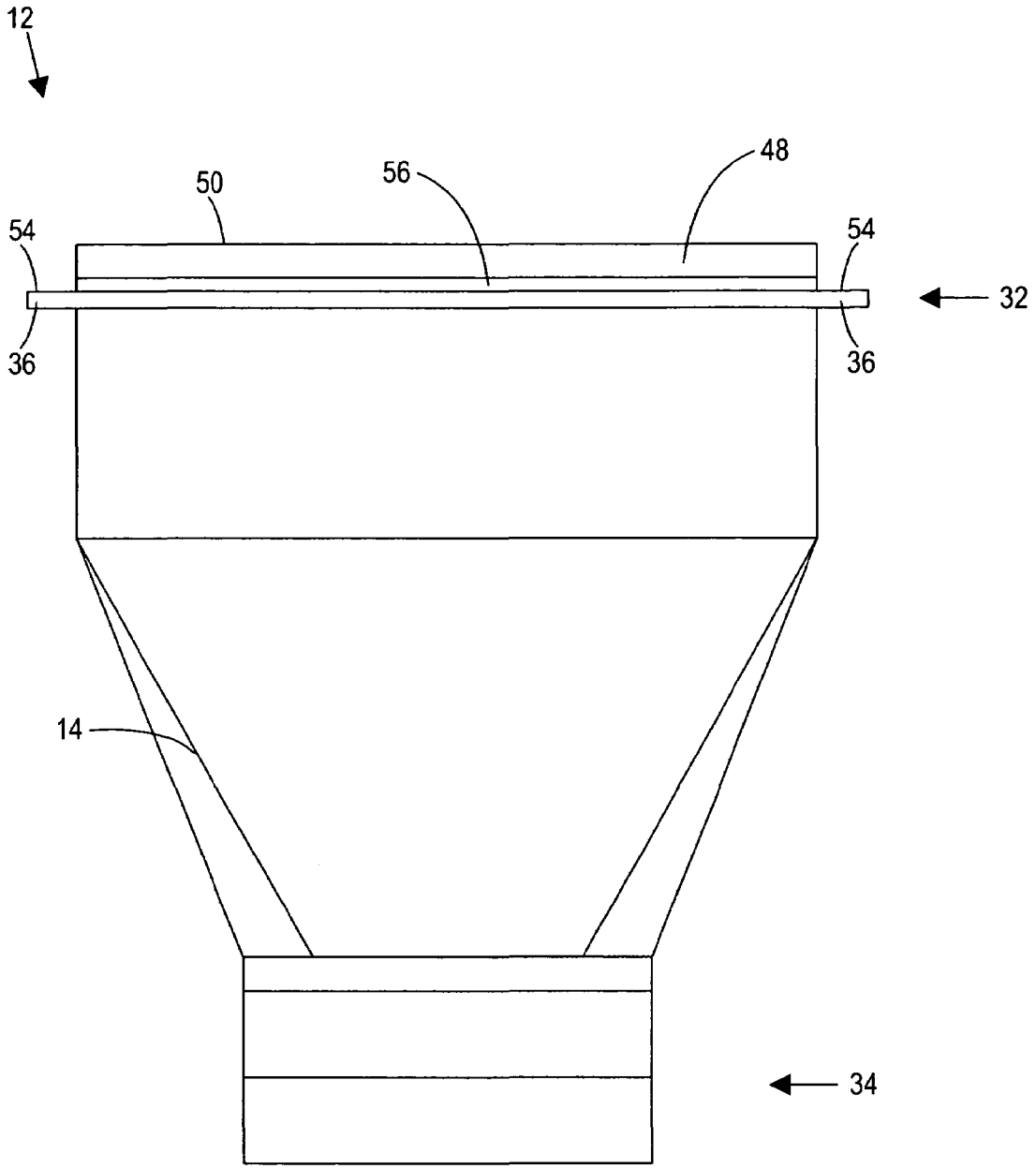
FIG. 7 is a rear elevation view of the duct section shown in FIG. 1.
Figure 8:
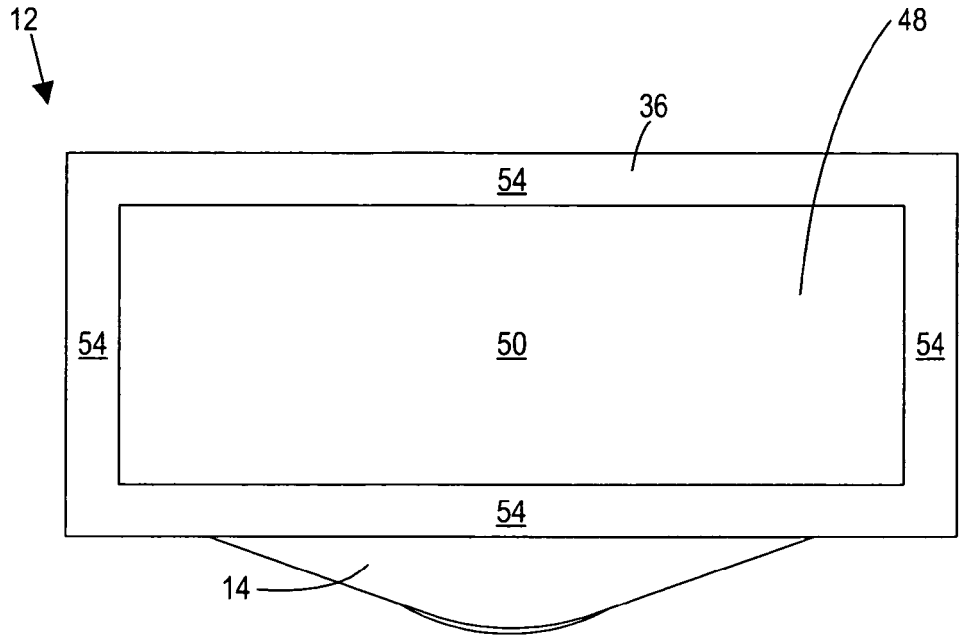
FIG. 8 is a top view of the duct section shown in FIG. 1.
Figure 9:
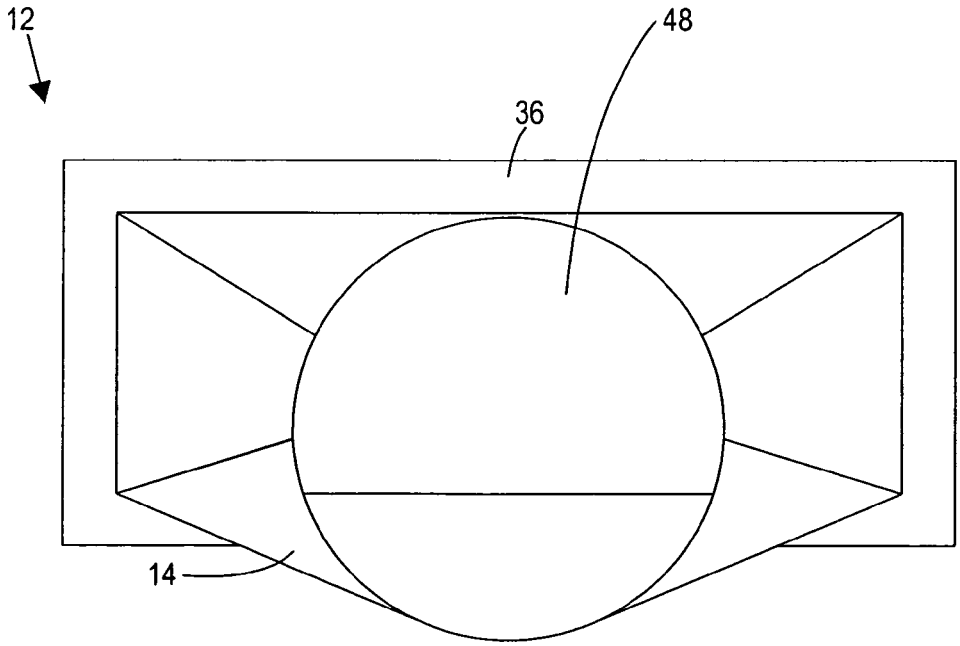
FIG. 9 is a bottom view of the duct section shown in FIG. 1.
Figure 10:
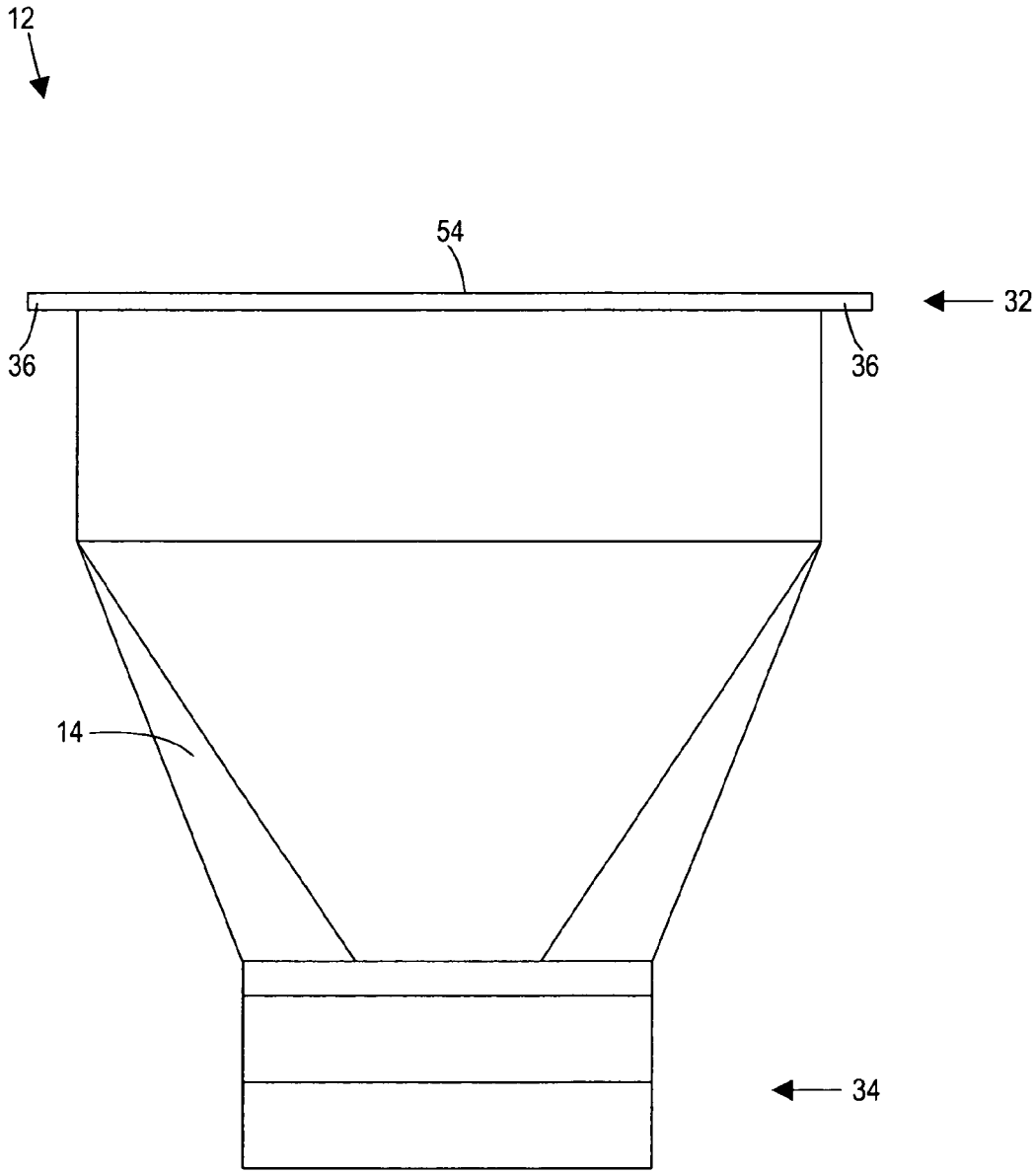
FIG. 10 is a front elevation view of the duct section shown in FIG. 1, illustrating the duct section without the cover.
Figure 11:
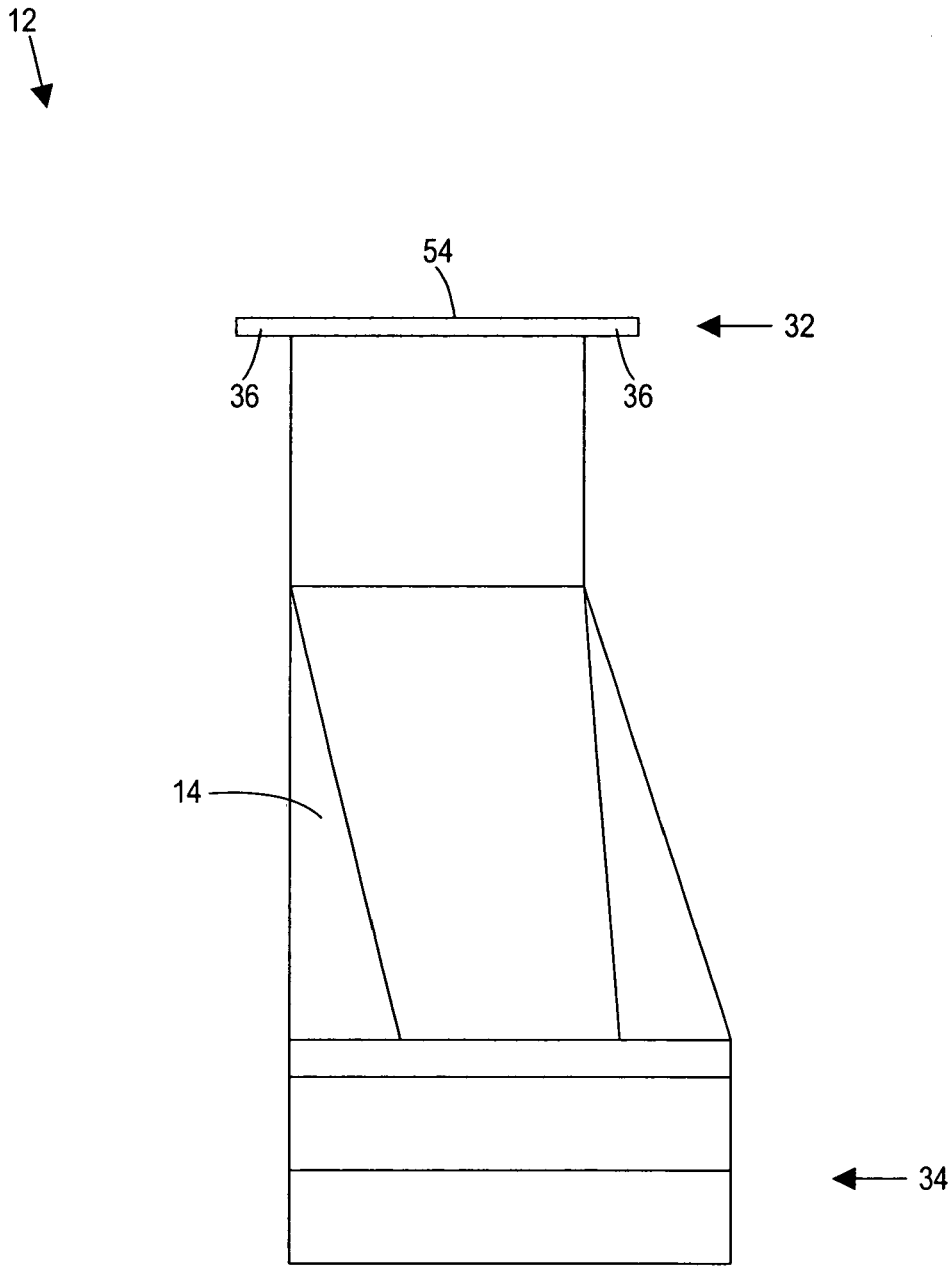
FIG. 11 is left side elevation view of the duct section shown in FIG. 10.
Figure 12:
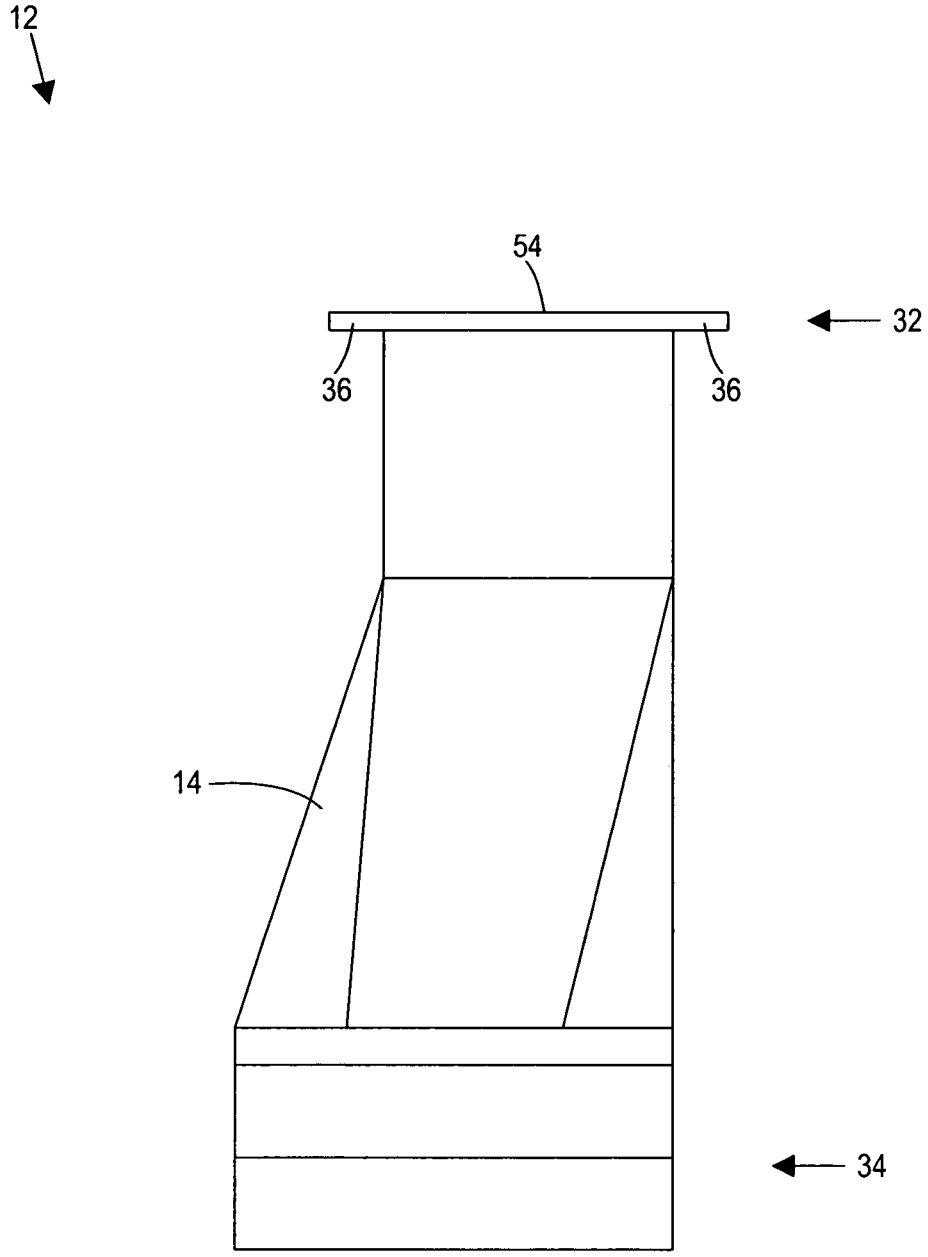
FIG. 12 is a right side elevation view of the duct section shown in FIG. 10.
Figure 13:
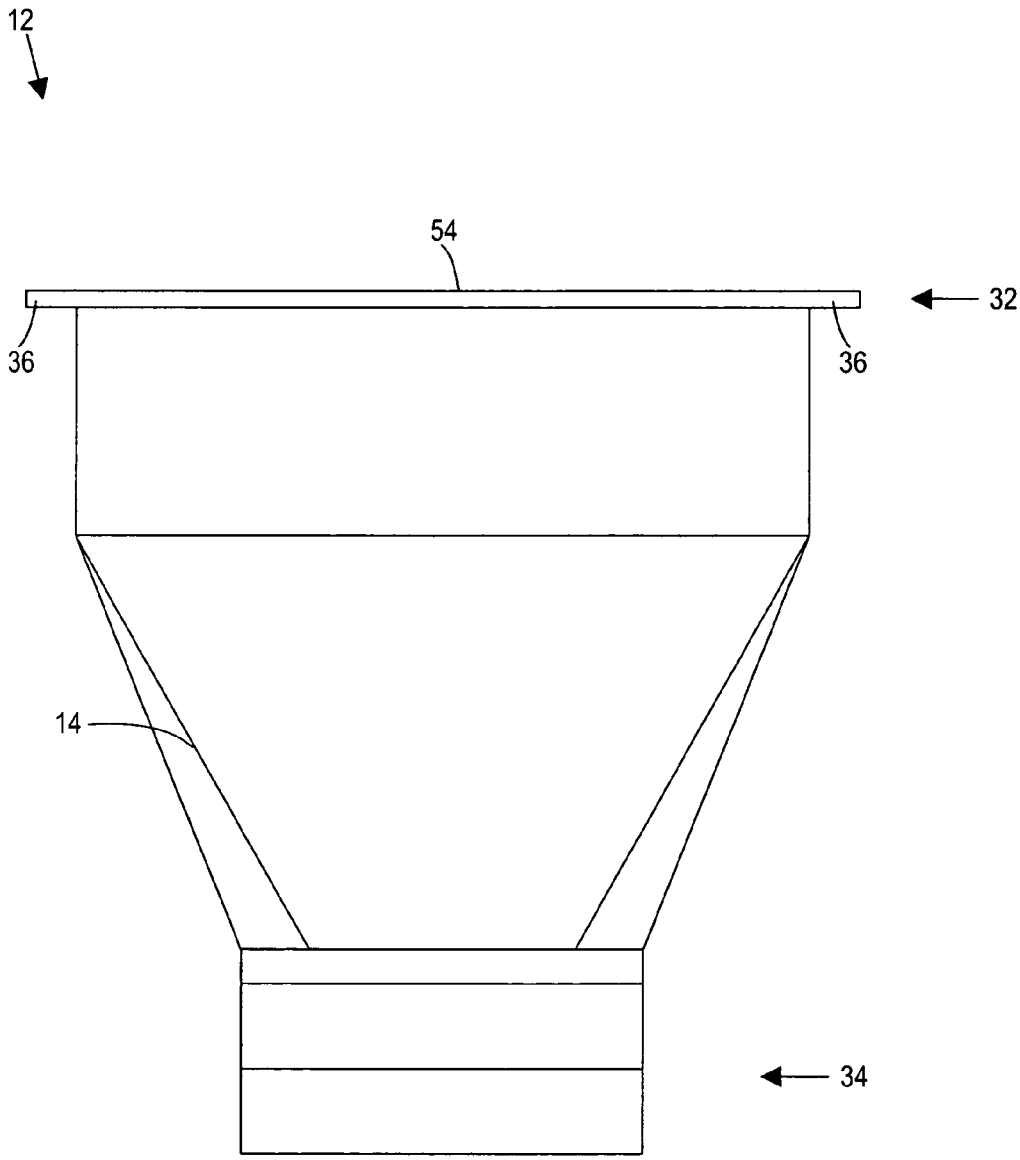
FIG. 13 is a rear elevation view of the duct section shown in FIG. 10.
Figure 14:
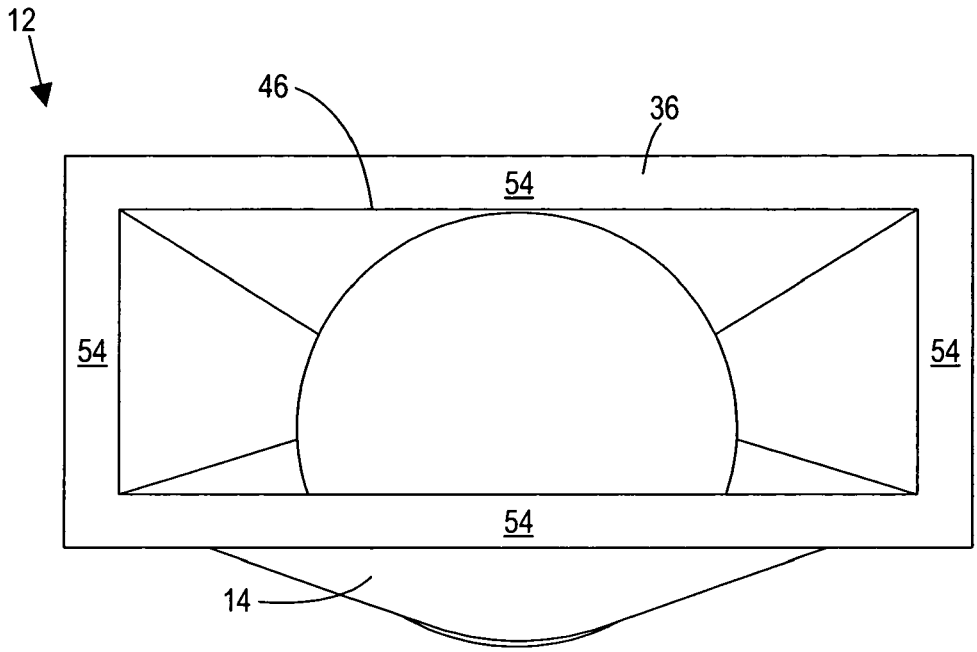
FIG. 14 is a top view of the duct section shown in FIG. 10.
Figure 15:
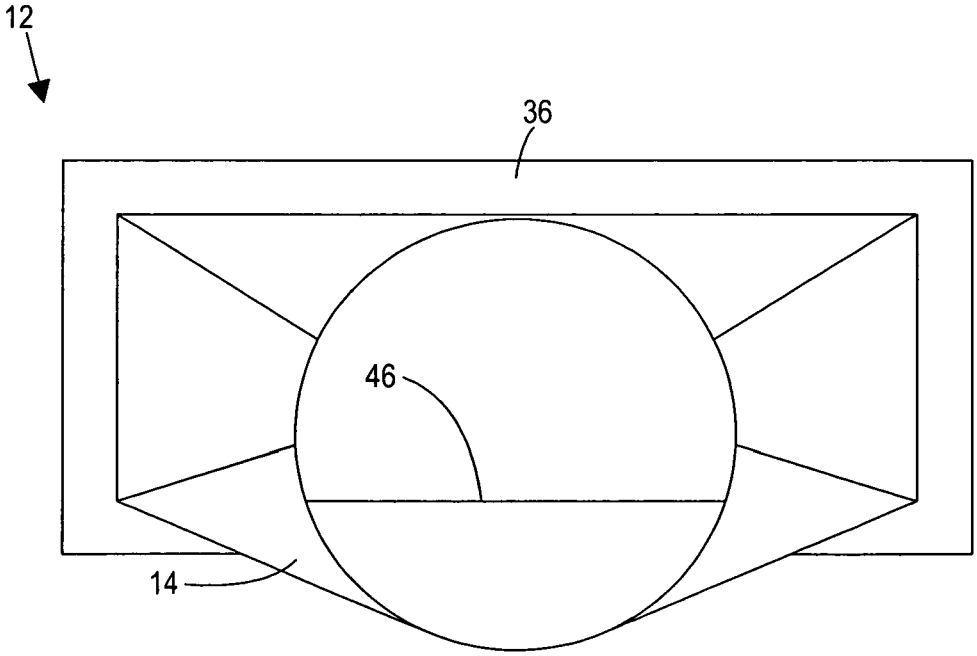
FIG. 15 is a bottom view of the duct section shown in FIG. 10.

An exemplary section of the duct is shown in FIG. 1 and this duct section 12 includes a body 14 with a first portion 16 that is sized and configured to provide an inlet or outlet and a second portion 18 that is sized and configured to provide an inlet. Advantageously, the second portion 18 may be coupled to another duct section if desired. Also, for example, the duct section 12 may include a body 20 (FIG. 2) including a first portion 22 that is sized and configured to provide a duct outlet or inlet and a second portion 24 configured to couple another duct section. Further, for example, the duct section 12 may include a body 26 (FIG. 3) including a first portion 28 sized and configured to provide a duct outlet or inlet and a second portion 30 configured to couple another duct section. Thus, the body of a duct section may be sized and configured to help form various types of boots known to those skilled in the art, such as a "straight boot" (FIG. 1), a "side boot" (FIG. 2) and an "end boot" (FIG. 3). However, the body of a duct section may be sized and configured to form any other suitable boots; and, if desired, a duct section may have any suitable number of portions configured to couple other duct sections and/or to provide one or more duct inlets or outlets.

It will be appreciated, however, that a duct section need not comprise a boot, a duct inlet or a duct outlet; and the duct section may comprise a variety of other duct work components. Moreover, the bodies 14, 20 and 26 of the duct section 12 may have a variety of other suitable sizes, shapes and configurations depending, for example, upon the particular configuration of the duct section.

A duct section may include one or more attachment portions, which may be sized and configured to connect the duct section to various structures. For example, as shown in FIG. 1, 4-7 and 10-13, the duct section 12 may include a first attachment portion 32 that is sized and configured to be attached to a floor, a wall, a ceiling, a truss, a joist, a support and/or other portions of a structure and a second attachment portion 34 that is sized and configured to be attached to a duct section. Also, for example, a duct section may include a first attachment portion sized and configured to be attached to a first duct section and a second attachment portion sized and configured to be attached to a second duct section. The attachment portions of a duct section may be attached to a duct section or other structure using one or more fasteners (such as nails, screws, staples, bolts and the like); one or more adhesives; a snap fit, a friction fit, and/or an interference fit; and/or other suitable means. It will be appreciated that the attachment portions of a duct section may have a variety of sizes, shapes and/or configurations.

As shown in FIGS. 1 and 4-19, the duct section 12 may include one or more flanges, projections or other outwardly extending portions 36. The flange 36 may extend outwardly from an outer surface of the body 14. The flange 36 preferably extends outwardly from an outer surface of the body 14 at about a ninety degree angle; however, the flange may extend outwardly at greater or lesser angles. The flange 36 may be disposed along all or a portion of an outer perimeter of the body 14. The flange 36 is preferably disposed along at least a substantial portion of an outer perimeter of the body 14.

As shown in FIGS. 1 and 4-19, the flange 36 of the duct section 12 may include one or more sets of generally opposing portions, and these generally opposing flange portions may form part of a generally continuous flange. However, the duct section 12 may include a plurality of discrete, spaced apart flanges, which may include one or more sets of generally opposing flange portions, if desired.

As shown in FIGS. 10-13, 17 and 19, the flange 36 is preferably generally flush with and/or generally aligned with an end of the body 14. For example, the flange 36 is preferably generally parallel to an end of the body 14. Also, for example, the flange 36 is preferably generally flush with an end of the body 14. It will be appreciated, however, that the flange 36 need not be aligned with an end of the body 14 and that the flange 36 be inwardly spaced apart from the ends of the body 14.

Figure 16:
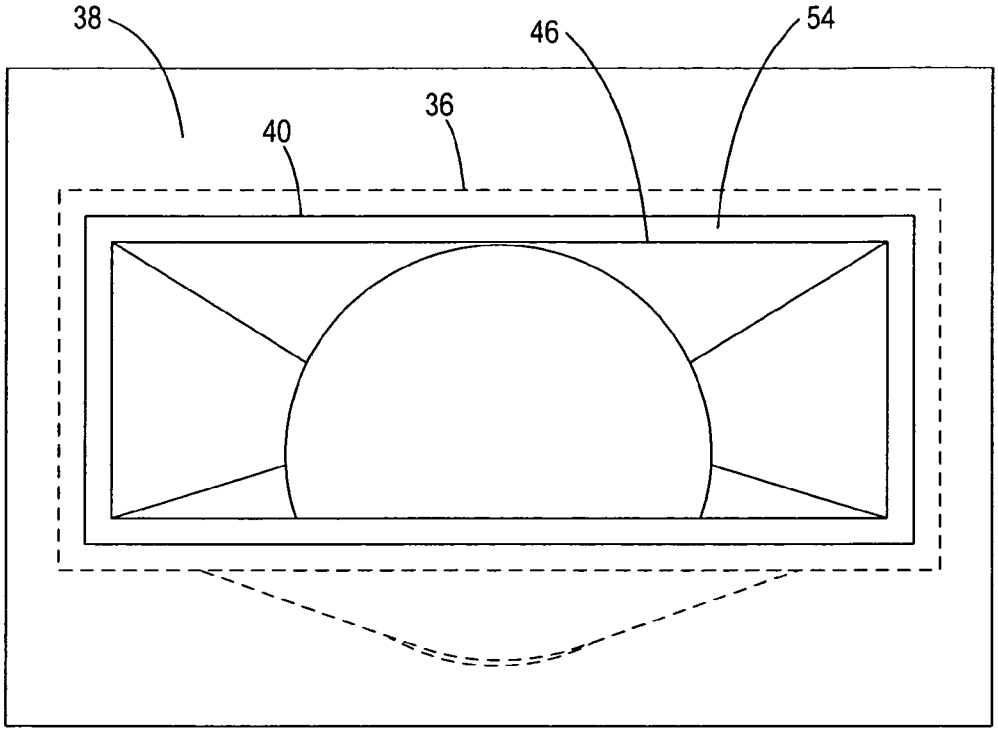
FIG. 16 is a front view of an exemplary arrangement including the duct section shown in FIG. 10 and an exemplary opening in a structure such as a floor, wall or ceiling.
Figure 17:
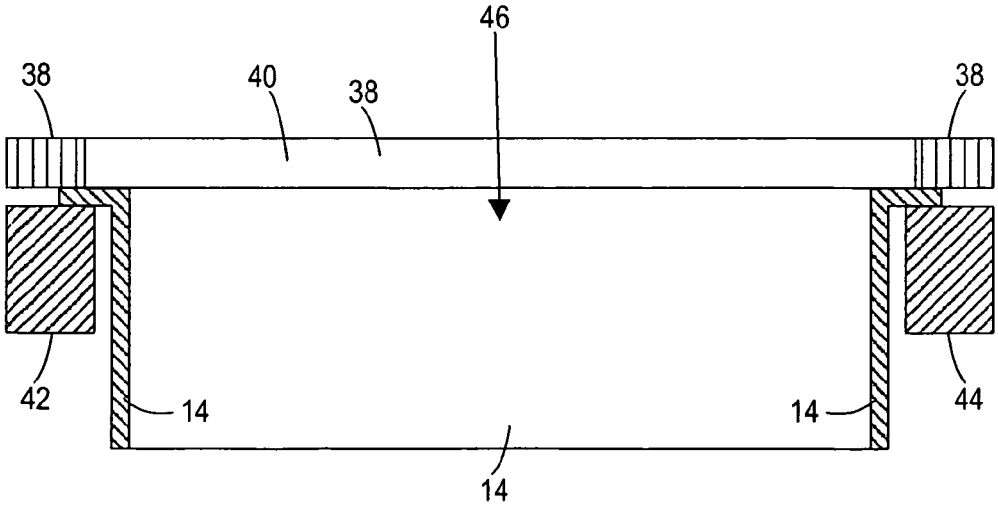
FIG. 17 is a cross sectional view of a portion of the exemplary arrangement shown in FIG. 16.
Figure 18:
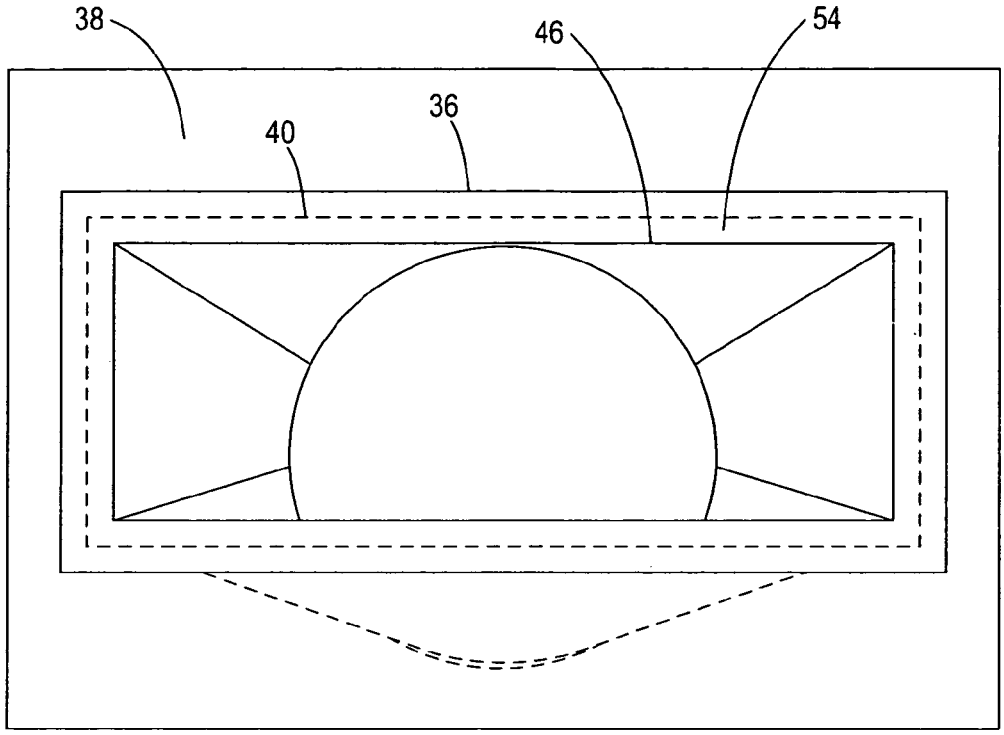
FIG. 18 is a front view of another exemplary arrangement including the duct section shown in FIG. 10 and an exemplary opening in a structure such as a floor, wall or ceiling.
Figure 19:
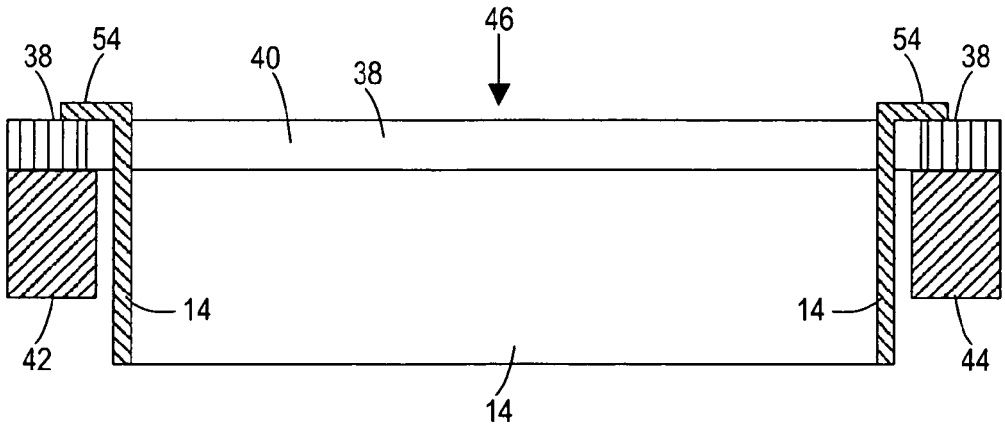
FIG. 19 is a cross sectional view of a portion of the exemplary arrangement shown in FIG. 18.

As shown in FIGS. 1 and 4-19, the attachment portion 32 of the duct section 12 may include the flange 36, and the flange may advantageously be sized and configured to be attached to a portion of a floor, a wall, a ceiling, a truss, a joist, a support and/or other portions of a structure. The supports may, for example, be sized and configured to support at least a portion of a floor, a wall and/or a ceiling. For example, as shown in FIGS. 16-19, a floor, wall or ceiling 38 may include opening 40, and the flange 36 may abut, contact, engage and/or be attached to the floor, wall or ceiling proximate the opening. Also, for example, as shown in FIGS. 16-17, flange 36 may abut, contact, engage and/or be attached to one or more supports 42, 44, such as joists or trusses.

Advantageously, the flange 36 may help increase the ease and efficiency of installing the duct section 12 by acting as a guide to help quickly and easily position the duct section 12 relative to the floor, wall or ceiling 38 and/or the supports 42, 44. In particular, as shown in FIGS. 16-19, the flange 36 may help increase the ease and efficiency of installing the duct section 12 because one or more portions of the flange 36 may abut the floor, wall or ceiling 38 and/or the supports 42, 44. Consequently, the flange 36 may help generally align an inlet-outlet opening 46 of the duct section 12 with the floor, wall or ceiling 38 and/or the supports 42, 44. In addition, the flange 36 may help position the duct section 12 in a generally square position relative to the floor, wall or ceiling 38 and/or the supports 42, 44.

The flange 36 may also help increase the ease and efficiency of installing the duct section 12 because the flange may be used with openings 40 that are not precisely sized. In particular, an opening 40 need not be slowly and painstakingly sized to accommodate the body 14 because the flange 36 may extend outwardly from the body to span a gap between the body and the opening, which may help seal that gap.

In addition, the flange 36 may help increase the ease and efficiency of installing the duct section 12 when installing a floor 38. For example, as shown in FIGS. 16-19, the flange 36 of the duct section 12 may rest upon the floor 38 and/or the supports 42, 44, which may advantageously allow a person to leave the duct section hanging from the supports to retrieve fasteners, adhesives and/or other suitable means used to fixedly attach the flange to the floor and/or the supports. Further, with the flange 36 resting upon the floor 38 and/or the supports 42, 44, a person may more easily operate a device (such as a nail gun, a staple gun, a hammer or other tool) used to fixedly attach the flange to the floor and/or the supports.

As shown in FIGS. 16-19, the flange 36 may be sized and configured to help provide a seal between the duct section 12 and the floor, wall or ceiling 38 and/or the supports 42, 44. For example, as shown in FIGS. 17 and 19-21, at least a portion of the flange 36 and at least a portion of the body 14 may be integrally formed as part of a unitary, one-piece structure during a molding process or other suitable manufacturing process. The unitary, one-piece structure may advantageously provide a generally air-tight and/or water-tight connection between the integrally formed portions of the flange 36 and the body 14, which may be used to provide a seal between the duct section 12 and the floor, wall or ceiling 38 and/or the supports 42, 44. It will be appreciated, however, that the duct section 12 does not require any flange 36 depending, for example, upon the particular configuration of the duct section.

As shown in FIGS. 1, 4-7 and 20, the duct section 12 may include one or more barriers, such as a cover 48. The cover 48 may be removed from the duct section 12 to uncover an opening, such as the opening 46 (FIGS. 14-19). Prior to being removed, the cover 48 may advantageously help prevent birds, other animals, water, dust, dirt, building materials and/or other debris from entering the duct 10 via the opening 46. If desired, the cover 48 may be sized and configured to be selectively removed from and returned to the duct section 12 to open and close the opening 46. It will be appreciated, however, that the duct section 12 does not require any cover 48 depending, for example, upon the particular configuration of the duct section.

Figure 20:
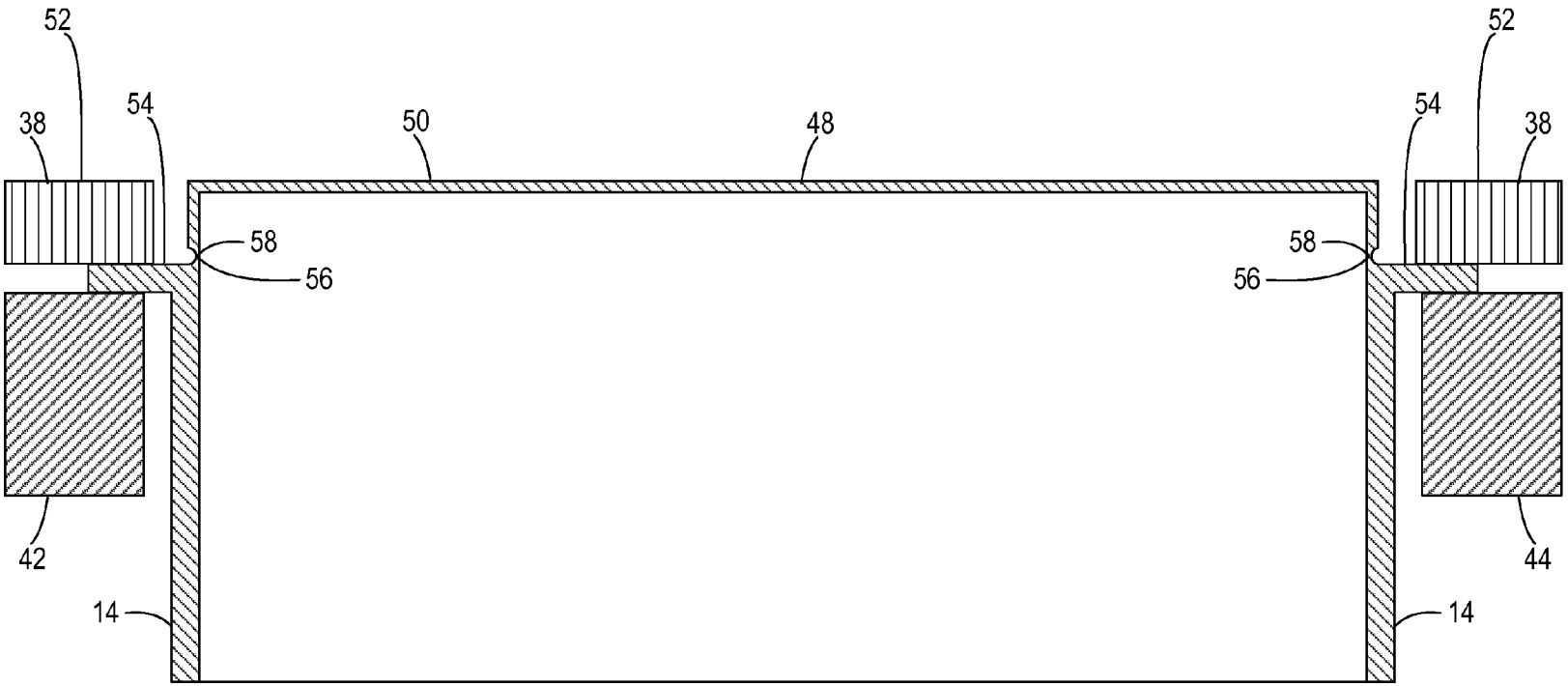
FIG. 20 is a cross sectional view of a portion of an exemplary arrangement including the duct section shown in FIG. 1 and an exemplary opening in a structure such as a floor, wall or ceiling.

An outer surface of the cover 48 may be generally aligned with an outer surface of the floor, wall or ceiling 38. As shown in FIG. 20, an outer surface 50 of the cover 48 may be sized and configured to be generally aligned with an outer surface 52 of a floor 38. For example, the outer surface 50 of the cover 48 may be spaced apart from and generally parallel to the outer surface 52 of the floor 38. Also, for example, the outer surface 50 of the cover 48 may be generally flush with the outer surface 52 of the floor 38. In one embodiment, the floor 38 may comprise a sub-floor and a floor covering (such as, carpet, tile or other floor coverings), and the outer surface 52 may comprise an upper surface of the floor covering. In another embodiment, the floor 38 may comprise a sub-floor, and the outer surface 52 may comprise an upper surface of the sub-floor.

As shown in FIG. 20, the distance between the outer surface 50 of the cover and an outer surface 54 of the flange may be customized to be about the thickness of the floor 38. For example, the floor 38 may comprise a sub-floor, and the distance between the outer surface 50 of the cover and the outer surface 54 of the flange may be customized to be about the thickness of the sub-floor. The thickness of the sub-floor may, for example, be any thickness between 19/32 inches (about 1.5 centimeters) and about 1-⅛ inches (about 2.9 centimeters). Of course, the sub-floor may have greater or lesser thicknesses, if desired. As shown in the accompanying figures, the outer surfaces 50, 52, 54 may be generally flat and/or smooth; however, the outer surfaces 50, 52, 54 may have a variety of textures and/or configurations.

Advantageously, because an outer surface of the cover 48 may be generally aligned with an outer surface of the floor, wall or ceiling 38, the cover may be less likely inadvertently struck or displaced. However, the outer surface 50 of the cover 48 need not be aligned with an outer surface of the floor, wall or ceiling 38; and the outer surface of the cover may be inwardly or outwardly spaced apart from the outer surface of the floor, wall or ceiling. Further, the outer surface 50 of the cover 48 may be generally aligned with and/or flush with the outer surface 54 of the flange 36 and/or an end of the body 14; and the outer surface of the cover may be inwardly or outwardly spaced apart from the outer surface of the flange and/or the ends of the body.

As shown in FIG. 20, the cover 48 may have a thickness that is smaller than the thickness of the body 14. For example, in one exemplary configuration, the cover 48 has a thickness of about 1/16 inches (about 1.6 millimeters) and the body 14 has a thickness of about 3/16 inches (about 4.8 millimeters). It will be appreciated, however, that the cover 48 and the body 14 may have any other suitable thicknesses. It will also be appreciated that the cover 48 may have a thickness that is generally equal to (or greater than) the thickness of the body 14 depending, for example, upon the particular configuration of the duct section 12. Further, the cover 48 may have a variety of sizes, shapes and configurations.

As shown in FIGS. 1, 4-7 and 20, the duct section 12 may include at least one narrowed portion 56. The narrowed portion 56 may be disposed along all or a portion of an outer perimeter of the cover 48. Preferably, the narrowed portion 56 is disposed along at least a substantial portion of an outer perimeter of the cover 48. In addition, the narrowed portion 56 is preferably continuously disposed along the outer perimeter of the cover 48; however, the duct section 12 may include a plurality of spaced apart discrete narrowed portions depending, for example, upon the particular configuration of the duct section.

As shown in FIGS. 1, 4-7 and 20, the narrowed portion 56 may advantageously connect the cover 48 to the body 14 and/or the flange 36. In addition, as best seen in FIG. 20, at least a portion of the cover 48, at least a portion of the narrowed portion 56, at least a portion of the body 14 and/or at least a portion of the flange 36 may be integrally formed as part of a unitary, one-piece structure during a molding process or other suitable manufacturing process. As shown in FIG. 20, the unitary, one-piece structure may provide a generally air-tight and/or water-tight connection between the integrally formed portions, which may advantageously help prevent water, dust, dirt, and/or other debris from entering the duct 10 via the opening 46. It will be understood, however, that the cover 48, the narrowed portion 56, the body 14 and the flange may comprise a plurality of discretely formed components. Moreover, the narrowed portion 56 need not be integrally formed during a molding process and may, for example, be formed after a molding or other suitable manufacturing process.

As shown in FIGS. 1, 4-7 and 20, the narrowed portion 56 may be sized and configured to facilitate removal of the cover 48. For example, as shown in FIG. 20, the narrowed portion 56 may comprise one or more scorings, grooves, channels or other inwardly extending portions that provide the narrowed portion with one or more tapered portions 58, which may be more easily folded, cut and/or torn. Also, for example, the narrowed portion 56 may comprise one or more perforations (not shown), which may be more easily folded, cut and/or torn; however, the narrowed portion 56 does not require any perforations. The narrowed portion 56 is preferably sized and configured to facilitate removal of the cover 48 without tools; however, the narrowed portion may facilitate removal of the cover using a knife, scissors, a saw, and/or other tools. It will be appreciated that the duct section 12 does not require any narrowed portion 56 depending, for example, upon the particular configuration of the duct section.

Figure 21:
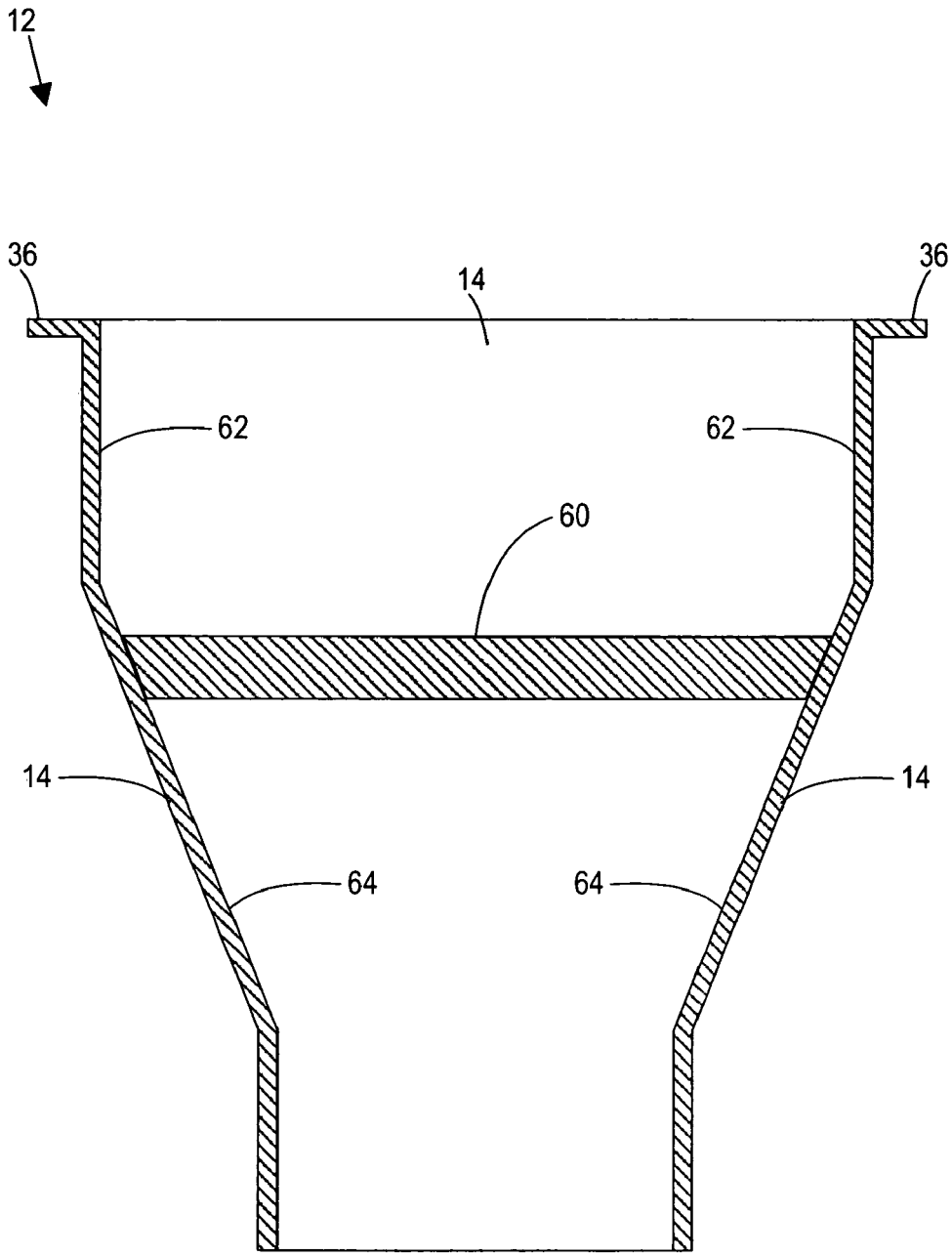
FIG. 21 is a cross sectional view of the duct section shown in FIG. 10 illustrating an exemplary barrier.

As shown in FIG. 21, the duct section 12 may also include a barrier 60. The barrier 60 may advantageously help prevent birds, other animals, water, dust, dirt, building materials and/or other debris from passing through the duct section. If desired, the barrier 60 may be sized and configured to be selectively removed from and returned to the duct section. Further, the barrier 60 may be sized and configured to be selectively removed and replaced with another barrier 60, if desired.

The barrier 60 may comprise one or more air-permeable portions. An air-permeable portion may comprise, for example, an air filter, a porous structure, a perforated structure, a net, a grate or other structure through which at least some air may pass. The air-permeable portions of the barrier 60 may permit an HVAC system to transmit at least some air through the duct section 12. For example, while a home, building or other structure is being constructed, it may be desirable to operate the HVAC system to transmit heated air (such as during the winter time) or cooled air (such as during the summer time) to various portions of the home, building or structure, which may provide construction workers with a more comfortable working environment. Thus, the barrier 60 may advantageously be sized and configured to permit transmission of at least some air through the duct section 12; but still may prevent at least some debris from passing through the duct section. Further, the barrier 60 may advantageously include an air filter, which may help extract impurities from air passing through the duct section 12. If desired, the duct section 12 may include a cover 48, a barrier 60 or both depending, for example, upon the particular configuration of the duct section. It will be understood that the barrier 60 does not require any air-permeable portions and that the barrier may include one or more non-air-permeable portions, one or more air-permeable portions, or both.

As shown in FIG. 21, the barrier 60 may abut, contact, engage and/or be attached to one or more portions of the duct section 12. In addition, the barrier 60 may be disposed within the hollow interior portion of the body 14 of the duct portion 12. Thus, for example, the barrier 60 may abut, contact, engage and/or be attached to an interior surface 62 of the body 14. However, the barrier 60 may be attached to the interior surface 62, other portions of the body 14, the flange 36, the cover 48 and/or any other portion of the duct section 12 using one or more fasteners; one or more adhesives; a snap fit, a friction fit, and/or an interference fit; and/or other suitable means.

As shown in FIG. 21, the body 14 may include a tapered portion 64 and the barrier 60 may be sized and configured to abut, contact, engage and/or be attached to the interior surface 62 of the tapered portion, as shown in FIG. 21. In addition, the barrier 60 may have one or more dimensions larger than the dimensions of the tapered portion 64 to permit the barrier to rest within the tapered portion. It will be appreciated that the duct section 12 does not require a body with any tapered portion. It will also be appreciated, that the duct section 12 does not require any barrier 60 depending, for example, upon the particular configuration of the duct section.

Advantageously, one or more components of a duct section (such as the bodies 14, 20, 26; the flange 36; the cover 48; the outer surfaces 50, 54; the narrowed portion 56; the tapered portions 58; the barrier 60; the interior surface 62; tapered portion 64; and/or any other portions of the duct section 12) may be constructed of plastic, such as PVC or other suitable plastic, or other suitable non-metal material. Advantageously, the plastic components may be relatively lightweight, making the duct section less expensive to ship and easier to install. Also, the plastic components may be relatively strong and/or durable. Additionally, the plastic components may be relatively weather and moisture resistant.

The plastic components may be quickly and easily manufactured via a molding process, such as injection molding, compression molding, rotary molding or other suitable molding process. Advantageously, any combination of the plastic components of a duct section may be integrally formed during a molding process as part of a unitary, one-piece structure.

In one exemplary manufacturing process, a plurality of unitary, one-piece structures may be discretely molded and then may be interconnected to form the duct section 12. For example, the duct section 12 may comprise a first molded half and a second molded half that may be interconnected using a snap fit, a friction fit, and/or an interference fit. If desired, the halves of the duct section 12 may also be interconnected using one or more fasteners; one or more adhesives; and/or an interference fit; and/or other suitable means. This exemplary manufacturing process may advantageously allow the duct section to be more quickly molded because the halves may be more quickly molded and/or removed from the mold when molded separately. In addition, this exemplary manufacturing process may advantageously allow one half of a duct section 12 to be saved when a defect is unintentionally formed in the other half. Further, the halves of the duct section may advantageously nest together to provide a more compact arrangement that is more efficient for storage and shipping.

It will be understood, however, that the duct section 12 may consist of a single unitary, one-piece structure depending, for example, upon the particular configuration of the duct section. Also, it will be understood that the components of a duct section need not be constructed using a molding process and that other manufacturing processes may be used to construct the duct section. In addition, it will be understood that some or all of the components of the duct section may be discretely formed as separate structures, which may be assembled later. It will be further understood that some or all of the components of a duct section may be constructed using metal, plastic, synthetics, polymers, other materials, or any combination thereof.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. An apparatus to be used in connection with a duct for a heating, ventilation and air conditioning (HVAC) system, the apparatus comprising:

an air duct boot body comprising:

a first end including an opening defined by a lip; and a second end that is sized and configured to be connected to a HVAC duct, the body conveying air from second end to the first end when the apparatus is being used for HVAC;

an outwardly extending flange disposed proximate the first end of the body, the flange including a generally planar upper surface and/or a generally planar lower surface, the flange being disposed at least substantially perpendicular to the air flow through the first end of the body when the apparatus is being used for HVAC, the upper surface and/or the lower surface of the flange being sized and configured to be connected to a preexisting support structure so that the apparatus can be positioned in a desired location relative to the support structure, the flange including an outer perimeter that is spaced apart from the body to facilitate attachment of the flange to the support structure; and a cover that is sized and configured to cover the opening in the first end of the body, the cover including an outer portion that is sized and configured to be disposed generally parallel to and flush with an outer, exposed surface of a floor, a wall or a ceiling when the cover is attached to the body, the outer portion of the cover being disposed generally parallel to the flange, the cover being disposed generally perpendicular to the intended air flow through the opening in the first end of the body when the cover is attached to the body, the cover including a lip with a lower surface that contacts an upper surface of the lip defining the opening in the first end of the body when the cover is attached to the body, the cover including an outermost perimeter that is generally aligned with an outer perimeter of the lip defining the opening in the first end of the body when the cover is attached to the body;

wherein, when the cover is removed from the body, the lip defining the opening in the first end of the body is exposed and recessed with respect to the outer, exposed surface of the floor, the wall or the ceiling;

wherein the lip defining the opening in the first end of the body is disposed generally perpendicular to the flange, generally parallel to the air flow through the first end of the body when the apparatus is being used for HVAC, forms at least a portion of the first end of the body when the cover is removed from the body, and includes a distal end that is spaced apart from and disposed downstream of the flange when the apparatus is being used for HVAC; and wherein the body, the flange and the lip are integrally formed as part of a unitary, one-piece structure.

2. The apparatus as in claim 1, wherein the body, the flange, the lip and the cover are constructed from plastic and integrally formed as part of the unitary, one-piece structure during a molding process.

3. The apparatus as in claim 1, wherein the preexisting support structure that the flange is sized and configured to be connected to helps form or support at least a portion of the floor, the wall or the ceiling.

4. The apparatus as in claim 1, wherein the outer portion of the cover has a generally planar upper surface.

5. The apparatus as in claim 1, further comprising a cover removing portion that is sized and configured to facilitate removal of the cover from the body.

6. The apparatus as in claim 5, wherein the cover removing portion is disposed between the cover and the flange.

7. The apparatus as in claim 1, wherein the cover has a generally planar upper surface that is spaced apart from and disposed in a different plane than that the flange.

8. The apparatus as in claim 1, wherein the body includes a generally planar sidewall and the flange is disposed generally perpendicular to the sidewall.

9. An apparatus to be used in connection with a heating, ventilation and air conditioning (HVAC) system, the apparatus being sized and configured to be at least partially supported by a preexisting support structure, the preexisting support structure including an opening and the apparatus being sized and configured to be at least partially disposed within the opening, the apparatus comprising:

an air duct boot including a body with a first attachment portion, a second attachment portion, a hollow interior portion and an opening in communication with the hollow interior portion, at least a portion of the body being sized and configured to be disposed in the opening of the preexisting support structure, the body conveying air from the second attachment portion to the first attachment portion when the apparatus is being used for HVAC, the second attachment portion being sized and configured to be attached to the HVAC system;

a flange extending outwardly from the body of the duct, the flange including a generally planar upper surface and/or a generally planar lower surface, the upper surface and/or the lower surface of the flange being sized and configured to be connected to the preexisting support structure to facilitate positioning the duct in a desired location, the flange including an outer perimeter that is spaced apart from the body to facilitate attachment to the support structure, the flange being disposed at least substantially perpendicular to the air flow through the first end of the body when the apparatus is being used for HVAC;

a cover covering at least a portion of the opening in the duct, the cover including an outer surface that is spaced apart from the flange and is sized and configured to be disposed generally parallel to and flush with an outer, exposed surface of a floor, a wall or a ceiling when the cover is attached to the body, the cover being disposed generally parallel to the flange, the cover being disposed generally perpendicular to the intended air flow through the opening in the duct when the cover is attached to an end of the duct; and a cover removing portion that is disposed between the cover and the flange, the cover removing portion being sized and configured to facilitate removal of the cover;

wherein, when the cover is removed from the body, a lip exposed by removing the cover is recessed with respect to the outer, exposed surface of the floor, the wall or the ceiling;

wherein the lip at least substantially defines the opening in the body of the duct, the lip being disposed generally perpendicular to the flange, the lip being disposed generally parallel to the air flow through the first end of the duct when the apparatus is being used for HVAC, the lip forming at least a portion of the end of the duct when the cover is removed from the body, the lip including a distal end that is spaced apart from and disposed downstream of the flange when the apparatus is being used for HVAC; and wherein the body, the flange, the cover and the cover removing portion are constructed from plastic and are integrally formed as part of a unitary, one-piece structure during a molding process.

10. The apparatus as in claim 9, wherein the lower surface of the flange is sized and configured to abut a portion of the preexisting support structure to facilitate positioning of the duct in the desired location.

11. The apparatus as in claim 9, wherein the upper surface of the flange is disposed generally parallel to and generally coplanar with an outer surface of the preexisting support structure.

12. The apparatus as in claim 9, wherein the upper surface of the flange is sized and configured to abut a rear surface of the floor, the wall or the ceiling.

13. The apparatus as in claim 9, wherein the lower surface of the flange is sized and configured to abut a portion of the preexisting support structure; and wherein the outer surface of the cover is spaced apart from and disposed generally parallel to an upper surface of the flange.

14. The apparatus as in claim 9, wherein the cover removing portion includes a groove to facilitate removing the cover from the body.

15. The apparatus as in claim 9, wherein the cover removing portion includes scoring to facilitate removing the cover from the body.

16. The apparatus as in claim 9, wherein the flange forms at least a portion of a seal between the floor, the wall or the ceiling and the body of the duct.

17. The apparatus as in claim 9, wherein the flange extends at least substantially around a perimeter of the body to help form a seal between the floor, the wall or the ceiling and the body of the duct.

18. The apparatus as in claim 9, wherein the cover removing portion forms a generally continuous seal between the cover and the flange.

19. The apparatus as in claim 9, further comprising an air filter at least partially disposed within the hollow interior portion of the body, the air filter being sized and configured to permit at least some air to pass through the hollow interior portion of the body.

20. An air duct boot for a heating, ventilation, and air conditioning (HVAC) system, the boot being sized and configured to be at least partially supported by a preexisting support structure, the preexisting support structure including an opening and the boot being sized and configured to be at least partially disposed within the opening, the air duct boot comprising:

a body including a first end, a second end, and a hollow interior portion, at least a portion of the body being sized and configured to be disposed in the opening of the preexisting support structure, the second end being sized and configured to be connected to the HVAC system, the body conveying air from the second end to the first end when the HVAC system is being used;

an outwardly extending flange disposed proximate the first end of the body, the flange including a generally planar upper surface and/or a generally planar lower surface, the upper surface and/or the lower surface of the flange being sized and configured to be connected to the preexisting support structure to facilitate positioning the boot in a desired location, the flange including an outer perimeter that is spaced apart from the body to facilitate attachment of the flange to the support structure, the flange being disposed at least substantially perpendicular to the air flow through the first end of the body when the HVAC system is being used;

an opening in the first end of the body, the opening being defined by a lip that is disposed generally perpendicular to the flange, the lip being disposed generally parallel to the air flow through the first end of the body when the HVAC system is being used;

a cover covering at least a portion of the opening in the body, the cover including an upper surface that is spaced apart from the flange and is sized and configured to be disposed generally parallel to and flush with an outer, exposed surface of a floor, a wall or a ceiling when the cover is attached to the body, the upper surface of the cover being disposed generally parallel to the flange, the cover being disposed generally perpendicular to the intended air flow through the opening in the body when the cover is attached to the body, the cover including a lip with a lower surface that contacts an upper surface of the lip defining the opening in the body when the cover is attached to the body; and an air filter at least partially disposed within the hollow interior portion of the body, the air filter being sized and configured to permit at least some air to pass through the hollow interior portion of the body;

wherein, when the cover is removed from the body, the lip defining the opening in the first end of the body is exposed and recessed with respect to the outer, exposed surface of the floor, the wall or the ceiling;

wherein the lip forms at least a portion of the first end of the body when the cover is removed from the body, the lip including a distal end that is spaced apart from and disposed downstream of the flange when the HVAC system is being used;

wherein the cover includes an outermost periphery that is disposed within an inner periphery of an opening in the floor, the wall or the ceiling; and wherein the body, the flange and the lip are integrally formed as part of a unitary, one-piece structure.

21. The air duct boot as in claim 20, wherein the body, the flange, the lip and the cover are integrally formed from plastic as part of a unitary, one-piece structure during a molding process.

22. The air duct boot as in claim 20, further comprising a cover removing portion that is disposed between the cover and the flange, the cover removing portion being sized and configured to facilitate removal of the cover.

23. The air duct boot as in claim 20, wherein the lower surface of the flange is sized and configured to abut a portion of the preexisting support structure; and wherein the upper surface of the cover and the upper surface of the flange are disposed in generally parallel planes.

24. The air duct boot as in claim 20, wherein the flange extends at least substantially around a perimeter of the body to help form a seal between the floor, the wall or the ceiling and the body of the boot.

25. An air duct boot for a heating, ventilation, and air conditioning (HVAC) system, the boot being sized and configured to be at least partially supported by a preexisting support structure, the preexisting support structure including an opening and the boot being sized and configured to be at least partially disposed within the opening, the air duct boot comprising:

a body that is at least partially constructed from plastic, the body including a first end and a second end, at least a portion of the body being sized and configured to be disposed in the opening of the preexisting support structure, the second end being sized and configured to be connected to the HVAC system, the body conveying air from the second end to the first end when the HVAC system is being used;

a flange extending outwardly from the body, the flange including a generally planar upper surface and/or a generally planar lower surface, the upper surface and/or the lower surface of the flange being sized and configured to be connected to the preexisting support structure to facilitate positioning the boot in a desired location, the flange including an outer perimeter that is spaced apart from the body to facilitate attachment to the support structure, the flange being at least partially constructed from plastic, the flange being disposed at least substantially perpendicular to the air flow through the first end of the body when the HVAC system is being used;

an opening in the first end of the body, the opening being defined by a lip that is disposed generally perpendicular to the flange, the lip being disposed generally parallel to the air flow through the first end of the body when the HVAC system is being used;

a cover that is at least partially constructed from plastic, the cover covering at least a portion of the opening in the body, the cover including a generally planar upper surface that is spaced apart from and disposed generally parallel to the upper surface of the outwardly extending flange, the generally planar upper surface of the cover being sized and configured to be disposed generally parallel to and flush with an outer, exposed surface of a floor, a wall or a ceiling when the cover is attached to the body, the cover being disposed generally perpendicular to the intended air flow through the opening in the first end of the body when the cover is attached to the body, the cover including a lip with a lower surface that contacts an upper surface of the lip defining the opening in the body when the cover is attached to the body; and a connecting portion that is sized and configured to facilitate removal of the cover from the body, the connecting portion being disposed between the cover and the flange;

wherein, when the cover is removed from the body, the lip defining the opening in the first end of the body is exposed and recessed with respect to the outer, exposed surface of the floor, the wall or the ceiling;

wherein the lip forms at least a portion of the first end of the body when the cover is removed form the body, the lip including a distal end that is spaced apart from and disposed downstream of the flange when the HVAC system is being used;

wherein the cover includes an outermost periphery that is disposed within an inner periphery of an opening in the floor, the wall or the ceiling; and wherein the body, the flange and the lip are integrally formed as part of a unitary, one-piece structure.

26. The air duct boot as in claim 25, wherein the flange extends at least substantially around a perimeter of the body to help form a seal between the preexisting structure and the body of the boot.

27. The air duct boot as in claim 25, further comprising a filter disposed within the body, the filter being sized and configured to prevent debris from passing through the boot.

28. An apparatus that is sized and configured to be used in connection with a duct for a heating, ventilation and air conditioning (HVAC) system, the apparatus being sized and configured to be at least partially supported by a preexisting support structure, the preexisting support structure including an opening and the apparatus being sized and configured to be at least partially disposed within the opening, the apparatus comprising:

an air duct boot body including a first end, a second end and a passageway that extends through the body, the second end being sized and configured to be connected to the HVAC duct, the body conveying air from the second end to the first end when the HVAC system is being used;

an opening disposed in the first end of the body, the opening being in communication with the passageway that extends through the body;

a lip forming at least a portion of the opening in the first end of the body, the lip including an upper surface, an outer surface and an inner surface, the lip being disposed generally parallel to the air flow through the first end of the body when the HVAC system is being used;

a flange extending outwardly from the body, the flange being disposed proximate the first end of the body and being spaced apart from the upper surface of the lip, the flange including an outer surface that is sized and configured to contact the preexisting support structure so that the apparatus can be positioned in a desired location relative to the support structure, the flange being disposed generally perpendicular to the air flow through the first end of the body when the HVAC system is being used; and a removable cover that covers at least a portion of the opening in the first end of the body when the cover is attached to the body, the cover being disposed generally parallel to the flange, the cover being disposed generally perpendicular to the intended air flow through the opening in the first end of the body when the cover is attached to the body, the cover including a lip with a lower surface that contacts the upper surface of the lip forming the opening in the first end of the body when the cover is attached to the body;

wherein, when the cover is attached to the body, an outer portion of the cover is sized and configured to be disposed at least generally parallel to an outer, exposed surface of a floor, a wall or a ceiling;

wherein, when the cover is removed from the body, the upper surface of the lip forming the opening in the first end of the body is exposed and recessed with respect to the outer, exposed surface of the floor, the wall or the ceiling;

wherein the lip forming the opening in the first end of the body is disposed generally perpendicular to the flange, forms at least a portion of the first end of the body when the cover is removed form the body and includes a distal end that is spaced apart from and disposed downstream of the flange when the HVAC system is being used;

wherein the cover includes an outermost periphery that is disposed within an inner periphery of an opening in the floor, the wall or the ceiling; and wherein the body, the flange and the lip are integrally formed as part of a unitary, one-piece structure.

29. The apparatus as in claim 28, wherein the body, the flange, the lip and the cover are constructed from plastic and are integrally formed as part of the unitary, one-piece structure during a molding process.

30. The apparatus as in claim 28, wherein the preexisting support structure that the flange is sized and configured to contact helps form or support at least a portion of the floor, the wall or the ceiling.

31. The apparatus as in claim 28, wherein the outer portion of the cover has a generally planar upper surface;

wherein the generally planar upper surface of the cover is disposed generally flush with the outer, exposed surface of the floor, the wall or the ceiling; and wherein the generally planar upper surface of the cover is disposed generally parallel to the flange.

32. The apparatus as in claim 28, further comprising a cover removing portion that is sized and configured to facilitate removal of the cover from the body.

33. The apparatus as in claim 28, wherein the first end of the body has a generally rectangular confirmation, the flange is disposed generally perpendicular to the generally rectangular first end of the body, and the lip is generally aligned with the generally rectangular first end of the body.

34. The apparatus as in claim 28, wherein the flange forms at least a portion of a seal between the floor, the wall or the ceiling and the body of the duct when the apparatus is connected to the preexisting structure.

35. The apparatus as in claim 28, further comprising a filter at least partially disposed within the body, the filter being sized and configured to allow at least some air to pass through the passageway and the opening when the cover is removed from the body.

* * * * *

UNITED STATES PATENT AND TRADEMARK OFFICE

CERTIFICATE OF CORRECTION

PATENT NO. : 7,390,251 B2
APPLICATION NO. : 11/282580
DATED : June 24, 2008
INVENTOR(S) : Leonard R. Hadlock, Jr.

It is certified that error appears in the above-identified patent and that said Letters Patent is hereby corrected as shown below:

Column 2
Line 30, change “such a” to --such as a--
Line 65, change “provide a” to --provide an--

Column 10
Line 56, change “12)” to --12--

Column 11
Claim 1, line 46, change “a HVAC” to --an HVAC--
Claim 1, line 47, change “from second” to --from the second--

Column 12
Claim 7, line 43, change “than that” to --than--

Column 16
Claim 25, line 15, change “form” to --from--

Column 17
Claim 28, line 18, change “form” to --from--

Signed and Sealed this

Fourth Day of August, 2009

John Doll

JOHN DOLL
*Acting Director of the United States Patent and Trademark Office*